US009416939B2

(12) United States Patent
Roth et al.

(10) Patent No.: US 9,416,939 B2
(45) Date of Patent: Aug. 16, 2016

(54) LED-BASED LIGHTING FIXTURE WITH TEXTURED LENS

(75) Inventors: Eric Anthony Roth, Tyngsboro, MA (US); Luc Guy Louis Lacroix, Dunstable, MA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 232 days.

(21) Appl. No.: 14/119,683

(22) PCT Filed: May 30, 2012

(86) PCT No.: PCT/IB2012/052706

§ 371 (c)(1), (2), (4) Date: Nov. 22, 2013

(87) PCT Pub. No.: WO2012/164500

PCT Pub. Date: Dec. 6, 2012

(65) Prior Publication Data

US 2014/0092604 A1 Apr. 3, 2014

Related U.S. Application Data

(60) Provisional application No. 61/491,676, filed on May 31, 2011.

(51) Int. Cl.

| | |
|---|---|
| ***F21V 5/04*** | (2006.01) |
| ***F21V 3/04*** | (2006.01) |
| ***F21V 13/04*** | (2006.01) |
| ***F21V 13/10*** | (2006.01) |

(Continued)

(52) U.S. Cl.

CPC ... *F21V 5/04* (2013.01); *F21K 9/50* (2013.01); *F21V 3/049* (2013.01); *F21V 13/04* (2013.01); *F21V 13/10* (2013.01); *F21Y 2113/002* (2013.01)

(58) Field of Classification Search

CPC ..... F21K 9/50; F21V 3/049; F21V 5/04; F21V 13/10; F21Y 2113/002

USPC ..... 362/249.02, 311.02

See application file for complete search history.

(56) References Cited

U.S. PATENT DOCUMENTS

| | | | |
|---|---|---|---|
| 4,100,594 | A | 7/1978 | Gould |
| 6,200,002 | B1 | 3/2001 | Marshall et al. |

(Continued)

FOREIGN PATENT DOCUMENTS

| | | | |
|---|---|---|---|
| GB | 2089956 | A | 6/1982 |
| WO | 2006105646 | A1 | 10/2006 |

(Continued)

OTHER PUBLICATIONS

Tim Whitaker; LED's Magazine: "Join the Lighting Revolution", Jan. 2005, pp. 1.

(Continued)

*Primary Examiner* — Anabel Ton

(74) *Attorney, Agent, or Firm* — Meenakshy Chakravorty

(57) ABSTRACT

Methods and apparatus related to a textured lens (30, 130). The textured lens includes a textured portion (40, 140) having plurality of unique textures. The lens may be utilized in a LED-based lighting fixture (10, 110) to, for example, reduce the presence of color banding and/or color shadows present in the light output of the lighting fixture. The textured portion may extend across all or portions of the lens surface.

20 Claims, 5 Drawing Sheets

(51) Int. Cl.
*F21K 99/00* (2016.01)
*F21Y 113/00* (2016.01)

(56) References Cited

U.S. PATENT DOCUMENTS 6,811,287 B2 * 11/2004 Roller ..... B60Q 1/30 362/336
7,588,358 B1 * 9/2009 Condon ..... B60Q 1/2696 362/485
8,434,883 B2 * 5/2013 Doan ..... F21V 3/049 362/256
2007/0013057 A1 1/2007 Mazzochette
2009/0303730 A1 12/2009 Holmberg

FOREIGN PATENT DOCUMENTS

WO 2009062053 A1 5/2009
WO 2009153347 A1 12/2009

OTHER PUBLICATIONS

Mike Hanney; "Secondary Optics for LEDs", Polymer Optics Limited, LED Forum, Moscow, Nov. 11, 2009, pp. 1-20.

* cited by examiner

LED-BASED LIGHTING FIXTURE WITH TEXTURED LENS

TECHNICAL FIELD

The present invention is directed generally to LED-based lighting fixtures employing textured lenses. More particularly, various inventive methods and apparatus disclosed herein relate to LED-based lighting fixtures with a lens having a textured portion with a plurality of unique textures.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects.

Some lighting fixtures may include one or more LEDs that include more than one die. For example, some lighting fixtures may include a single LED that has multiple dies. Also, for example, some lighting fixtures may include multiple LEDs that each includes at least one die. When more than one LED die is utilized in a lighting fixture, then banding and/or color shadows may occur at the edge of the beam pattern emitted by such lighting fixtures.

For example, if a lighting fixture includes a blue, green, and red LED in combination with a reflector partially surrounding the LEDs, the LED(s) that are most closely adjacent the reflector edge will be cut-off by the reflector from the main beam of the light output. Accordingly, the main beam of the light output will have a "white" color from the combined red, green, and blue light, but color banding will be present peripherally of the main beam of the light output. The color banding may be caused, for example, by the blocking of light output from one or more LEDs by the reflector edge.

Also, for example, a lighting fixture may include multiple LED dies and light emitted by one or more of the LED dies may exit the lighting fixture uncontrolled, thereby potentially causing streaks of light to appear peripherally of the main beam emitted by the lighting fixture. These streaks of light may be present in, for example, LED-based cove lights or linear grazing fixtures mounted close to a wall or other surface. Uncontrolled light may be emitted from the sides of the fixture due to Fresnel reflections and/or mechanical restraints of the lighting fixture. Such color bands and color shadows are generally not desirable for lighting fixtures.

Thus, there is a need in the art to provide a lens that may be implemented in a lighting fixture to reduce the presence of color banding and/or color shadows present in the light output of the lighting fixture.

SUMMARY

The present disclosure is directed to inventive methods and apparatus for a textured lens and, more specifically, to a lens having a textured portion with a plurality of unique textures utilized in a LED-based lighting fixture to reduce the presence of color banding and/or color shadows present in the light output of the lighting fixture. For example, the lens may be placed across the light output opening of a LED-based lighting fixture and intersect light output generated by a multi-die LED light source. The lens may include a substantially texture-free portion and a textured portion. The textured portion may have a plurality of distinct textures and may transition from a relatively light texture to a heavier texture across a width thereof.

Generally, in one aspect, the invention relates to a lighting fixture that includes a housing, an LED light source, and a lens. The housing defines at least one light output opening. The LED light source includes a plurality of LED dies, is retained within the housing, and emits a light output. At least some of the light output travels through the light output opening. The lens is provided across the light output opening and has a substantially texture-free portion and a textured portion. The textured portion is provided along at least a portion of a periphery of the lens. As the textured portion moves farther from the texture-free portion and closer to the periphery, texturing thereof transitions from a first texturing having a first depth, to a second texturing having a second depth greater than the first depth, to a third texturing having a third depth greater than the second depth.

In some embodiments the textured portion is provided around the majority of the periphery of the lens. In some versions of those embodiments the textured portion is provided around the entirety of the periphery of the lens. In some versions of those embodiments the texture-free portion constitutes a majority of the lens. In some versions of those embodiments the texture-free portion constitutes at least eighty percent of the lens.

In some embodiments the lens is an outermost lens of the lighting fixture.

Generally, in another aspect, the invention relates to a lighting fixture that includes a housing, an LED light source, and a lens. The LED light source is retained within the housing and emits a light output having a light output intensity and a plurality of unique spectrums. The lens is coupled to the housing and intersects at least some of the light output. The lens has a substantially texture-free portion and a textured portion. The texture-free portion intersects a continuous at least half of the light output intensity including a median value of the light output intensity. The textured portion gradually transitions from a first texturing having a first depth to a second texturing having a second depth at least four times greater than the first depth. The first texturing is more proximal to the texture-free portion than the second texturing is to the texture-free portion.

In some embodiments, the texture-free portion intersects at least seventy percent of the light output intensity.

In some embodiments, the texture-free portion intersects at least ninety percent of the light output intensity. In some versions of those embodiments, the textured area is provided around the entirety of a periphery of the lens.

In some embodiments, the textured area is provided around a majority of a periphery of the lens.

In some embodiments, the lens is substantially planar. In some versions of those embodiments the lens is rectangular.

In some embodiments, the texture-free portion is completely texture-free.

Generally, in another aspect, the invention relates to a lighting fixture that includes a housing, a multi-spectrum LED light source retained within the housing and emitting a light output, and a lens coupled to the housing. The LED light source has a light output intensity and the lens has a textured portion across at least a portion thereof. The lens intersects at least some of the light output. The textured portion extends substantially to the edge of the lens and includes a light texture zone most distal the edge having a light average depth of less than 0.002 inches and a heavy texture zone most proximal the edge having a heavy average depth at least twice the light average depth.

In some embodiments, the textured portion is integrally formed in an exterior facing surface of the lens.

In some embodiments, the lens includes a texture-free portion interior of the textured portion. In some versions of those embodiments the texture-free portion intersects at least fifty percent of the light output intensity of the intersected light. In some versions of those embodiments the texture-free portion intersects at least eighty percent of the light output intensity.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Some lighting fixtures may include one or more LEDs that include more than one die. However, light output emitted by some of those lighting fixtures includes undesired banding and/or color shadows at the edge of the beam pattern due to, for example, cut-off from lighting fixture components and/or uncontrolled light from one or more LED dies. Thus, Applicants have recognized and appreciated that it would be beneficial to provide a lens that may be implemented in an LED-based lighting fixture to reduce the presence of color banding and/or color shadows present in the light output of the lighting fixture. More generally, Applicants have recognized and appreciated that it would be beneficial to employ a lens with a textured portion that may optionally include a plurality of unique textures across a width thereof.

In view of the foregoing, various embodiments and implementations of the present invention relate to a textured lens.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention. For example, various embodiments of the textured lens disclosed herein are depicted in combination with particular lighting fixtures having particular LED light sources. However, other LED-based lighting fixtures incorporating the textured lens are contemplated without deviating from the scope or spirit of the claimed invention. For example, a textured lens may be implemented in other LED-based lighting fixtures where a multi-source shadow or color banding is not desired proximal the edges of a beam pattern. Also, for example, a textured lens may be implemented in lighting fixtures where unwanted light coming from one direction of the lighting fixture needs to be blended with the main beam without causing a noticeable change in intensity or beam angle.

Figure 1:
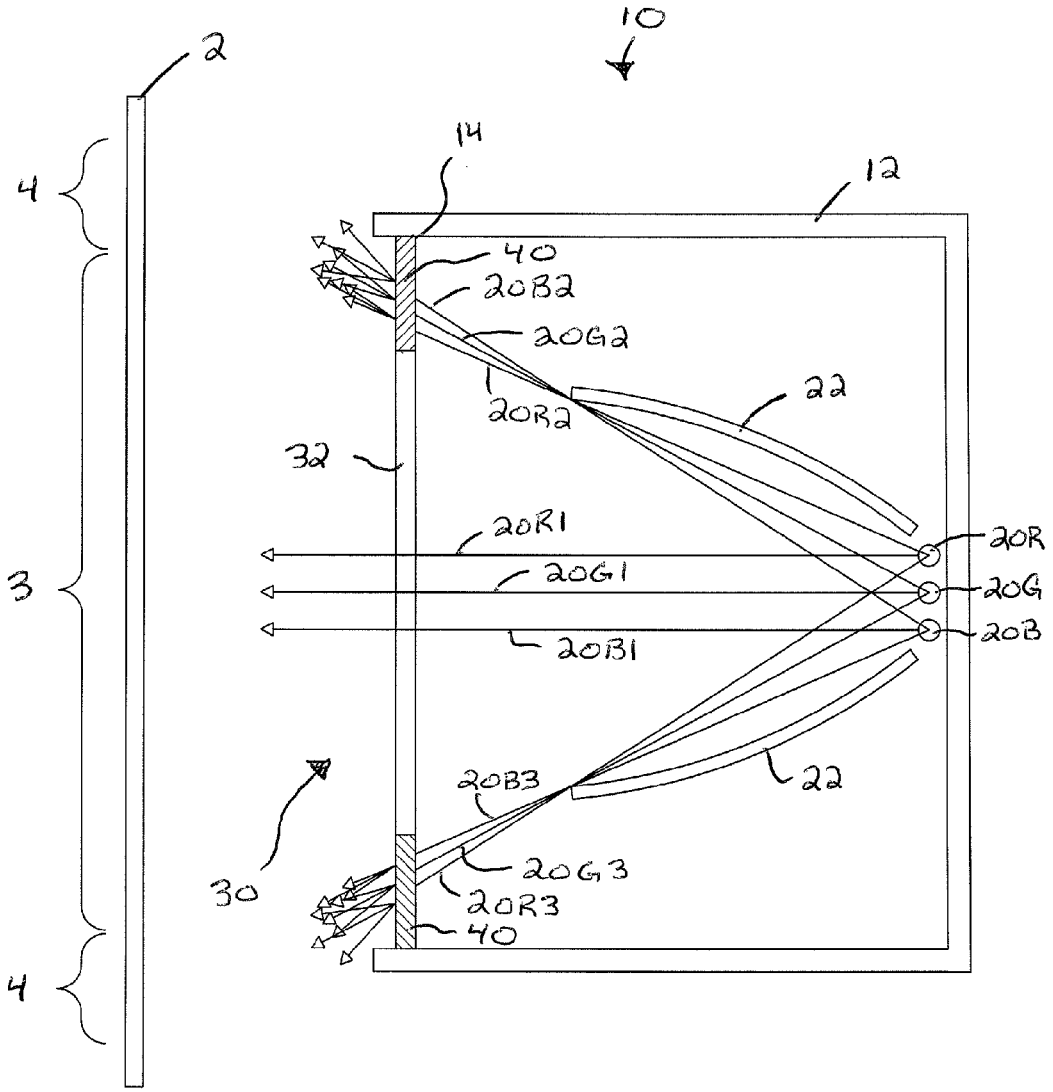
FIG. 1 illustrates a first embodiment of a lighting fixture having a textured lens across a light output opening thereof; the lighting fixture is shown adjacent an illumination surface.

Referring initially to FIG. 1, in one embodiment a LED-based lighting fixture 10 is provided with a textured lens 30. The lighting fixture 10 is illustrated schematically in FIG. 1 and includes a housing 12. The housing 12 retains the textured lens 30 across a light exit opening 14 thereof. The lens 30 is the outermost lens in the lighting fixture 10. However, in other embodiments another lens (e.g., a non-textured lens) may be provided outward of the lens 30 across a light output opening and the lens 30 may be provided interiorly thereof across an interior light output opening. The housing 12 also retains a LED-based light source having a red LED 20R, a green LED 20G, and a blue LED 20B. The LEDS 20R, 20G, and 20B may optionally be mounted on a printed circuit board (PCB) and/or a heatsink supported within the housing 12. The LEDS 20R, 20G, and 20B may be powered simultaneously at given current levels to collectively produce substantially white light, powered simultaneously at other current levels to collectively produce other colors of light, and/or may be powered individually and/or in combination with one other of LEDs 20R, 20G, and 20B to produce other colors of light. A controller may optionally be utilized in combination with the LEDS 20R, 20G, and/or 20B to control the light output produced thereby.

Although three LEDs 20R, 20G, and 20B are illustrated in FIG. 1, one of ordinary skill in the art having had the benefit of the present disclosure will recognize and appreciate that in alternative embodiments more or fewer LEDs may be provided, including LEDs of additional and/or alternative colors. For example, in some embodiments one or more white LEDs may be provided in addition to LEDS 20R, 20G, and 20B. Additionally, one of ordinary skill in the art having had the benefit of the present disclosure will recognize and appreciate LEDs may be alternatively positioned and/or arranged within a lighting fixture in alternative embodiments. For example, in some embodiments the LEDs may be non-planar with respect to one another, non-planar with respect to a lens 30 of the lighting fixture 10, non-centered within the housing 12, and/or alternatively distributed within the housing 12.

Provided about the LEDs 20R, 20G, and 20B is a reflector 22. Only two segments of reflector 22 are illustrated in FIG. 1, but it is understood that the reflector 22 may optionally extend completely about the LEDs 20R, 20G, and 20B in some embodiments. One of ordinary skill in the art having had the benefit of the present disclosure will recognize and appreciate that in alternative embodiments alternative optical elements may optionally be provided in combination with the LEDs to direct a desired light distribution to the lens 30. For example, in some embodiments a non-symmetric reflector may be provided about one or more LEDS, a reflector may provided only partially about the LEDs, and/or an optical lens may be provided over one or more LEDs. The reflector 22 is configured to generally direct light output from the LEDs 20R, 20G, and 20B towards the textured lens 30.

Three exemplary light rays are depicted emanating from each of the LEDS 20R, 20G, and 20B. It is understood that each of the LEDs will emit many other light rays than those depicted herein, some of which may contact and be redirected by the reflector 22 one or more times. Light rays 20R1, 20G1, and 20B1 are directed substantially perpendicular to the lens 30, contact a substantially texture-free portion 32 thereof, and are transmitted therethrough without being substantially scattered. Other light rays will contact the substantially texture-free portion 32 at non-perpendicular angles (some after contacting reflector 22 one or more times) and will likewise be transmitted therethrough without being substantially scattered. The substantially texture-free portion 32 may alter the path of light rays transmitted therethrough depending on one or more factors such as, for example, the index of refraction of the substantially texture-free portion 32, the incidence angle of the light ray(s), and/or the thickness of the substantially texture-free portion 32. The light transmitted through substantially texture-free portion 32 is generally directed toward a main beam portion 3 of an illumination area 2.

Light rays 20R2, 20G2, and 20B2 are directed just beyond an upper extent of the reflector 22, contact a textured portion 40 of the lens 30, and are transmitted through, and scattered by, the textured portion 40. Other light rays will contact the textured portion 40 (some after contacting reflector 22 one or more times) and will likewise be transmitted through and scattered by the lens 30. Due to the gradually increasing texturing of lens 30 described herein, the light ray 20R2 that contacts the textured portion 40 most closely adjacent to the substantially texture-free portion 32 is scattered less than the light ray 20G2 (that contacts the textured portion 40 farther from substantially texture-free portion 32 than light ray 20R2). Likewise, light ray 20G2 is scattered less than the light ray 20B2 (that contacts the textured portion 40 farther from substantially texture-free portion 32 than light ray 20G2). The textured portion 40 may also optionally alter the path of light rays transmitted therethrough prior to the light rays contacting the textured surface depending on one or more factors such as, for example, the index of refraction of the textured portion 40, the incidence angle of the beam, and/or the thickness of the textured portion 40.

Other light rays 20R3, 20G3, and 20B3 are also directed just beyond an upper extent of the reflector 22, contact another section of the textured portion 40, and are transmitted through, and scattered by, the textured portion 40. Due to the gradually increasing texturing of lens 30 described herein, the light ray 20B3 is scattered less than the light ray 20G3, and light rays 20B3 and 20G3 are both scattered less than the light ray 20R3. The light transmitted through substantially textured portion 40 is generally directed toward a scattered beam portion 4 of the illumination area 2. In lighting fixtures that do not implement the textured lens 30, some or all of such portions of an illumination area peripheral of the main beam portion 5 may experience undesired color banding and/or shadows.

Figure 2:
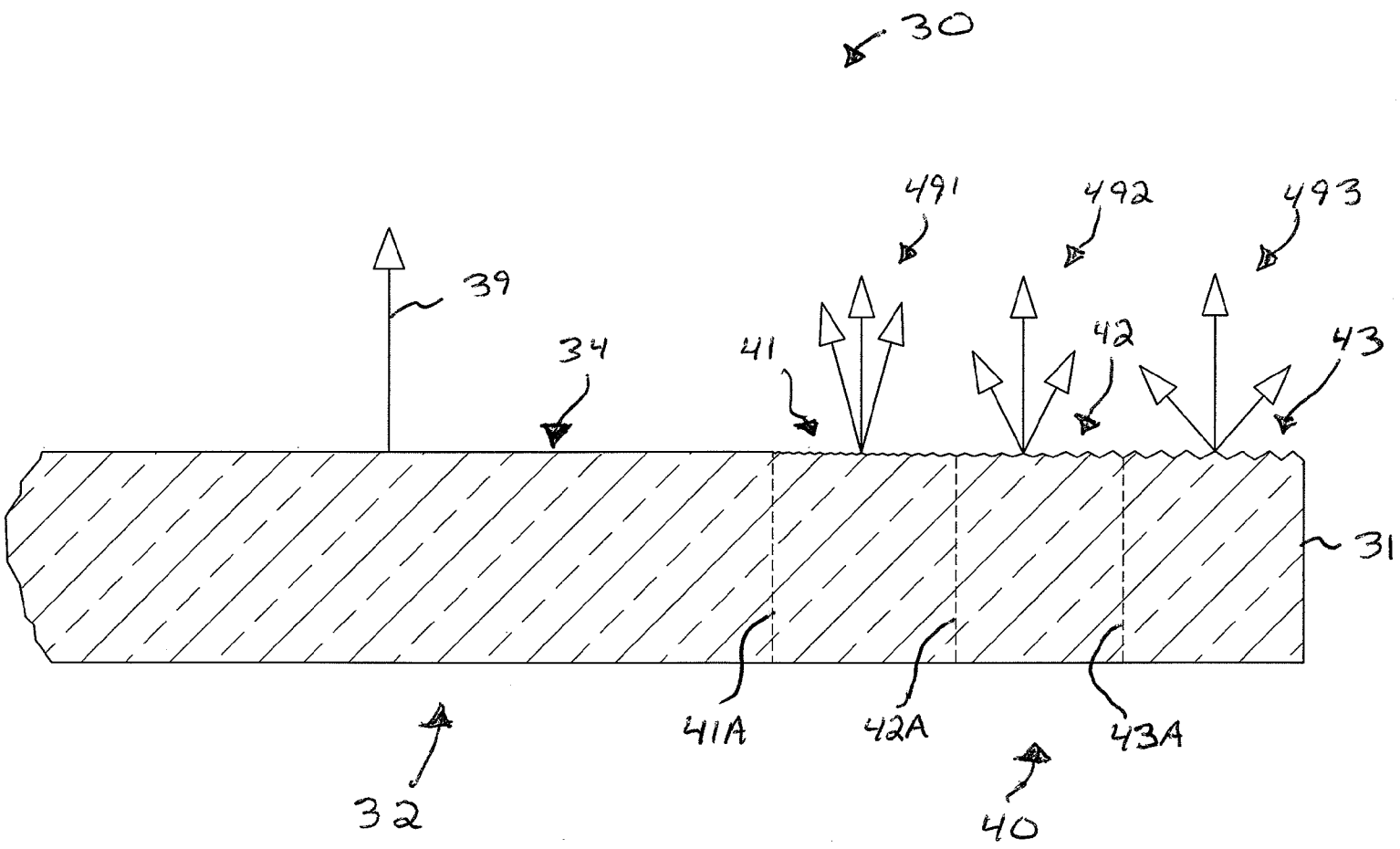
FIG. 2 illustrates a section view of a portion of the textured lens of FIG. 1.

Referring to FIG. 2, a section view of a portion of the textured lens 30 of FIG. 1 is illustrated. The section includes an edge 31 of the lens 30 and is taken along a portion of the textured portion 40 and a portion of the texture-free portion 32. It is illustrated that the texture-free portion 32 has a substantially smooth texture-free exterior face 34 and that light rays transmitted therethrough such as light ray 39 are not substantially scattered. An imaginary dashed line 41A generally represents the beginning of the textured portion 40 and the beginning of a lightly textured section 41 thereof. Dashed line 42A generally represents the beginning of a medium textured section 42 of the textured portion 40 and dashed line 43A generally represents the beginning of a heavy textured section 43 of the textured portion 40. It is illustrated that the degree of texturing increases gradually across each section 41, 42, 43 as you move outward from the substantially texture-free section 32. For example, the degree of texturing in medium textured section 42 is greater close to dashed line 43A than it is close to dashed line 42A. Light rays 491, 492, 493, are illustrated transmitted through respective sections 41, 42, 43. It is illustrated that the degree of scattering of the light rays 491, 492, 493 increases as the degree of texturing increases.

In some embodiments, the degree of texturing may increase linearly across all or portions of textured portion 40. In other embodiments the degree of texturing may additionally or alternatively increase exponentially and/or vary according to some other function across all or portions of textured portion 40. For example, in some alternative embodiments lightly textured section 41 may comprise a first substantially constant degree of texturing, medium textured section 42 may comprise a greater second substantially constant degree of texturing, and heavy texturing section 43 may comprise an even greater third substantially constant degree of texturing. Embodiments that implement a light texturing immediately adjacent the substantially texture-free area 32 and gradually increase texturing may eliminate the appearance of a visible transition line between textured and non-textured portions in the light output. Although substantially texture-free area 32 is illustrated as not having any texture at all, in alternative embodiments the substantially texture-free area 32 may contain a light texture across all or portions thereof that minimally affects light intensity of the light transmitted therethrough. For example, in some embodiments the substantially texture-free area 32 will have a texture on the outer surface thereof that is lighter than the texturing of the lightly textured section 41.

In some embodiments, the lightly textured section 41 may have an average depth of approximately 0.0004 inches with a one degree minimum draft, the medium textured zone 42 may have an average depth of approximately 0.002 inches with a three degree minimum draft, and the heavy textured zone 43 may have an average depth of approximately 0.0045 inches with a six and a half degree minimum draft. In versions of those embodiments the depth may be substantially consistent across the width of each of the zones 41-43. In other versions the depth may vary across the width of one or more of the zones 41-43. For example, in some embodiments the depth may increase in each of the zones in relation to the distance away from the substantially texture-free portion 32. In some embodiments the lightly textured section 41 may have a texture that substantially conforms to Mold-Tech standard 11000, the medium textured zone 42 may have a texture that substantially conforms to Mold-Tech standard 11030, and the heavy textured zone 43 may have a texture that substantially conforms to Mold-Tech standard 11050.

The surface of the textured section 40 can be textured in many ways for light scattering or redirecting the light. For example, in some embodiments the texture may be created by an injection mold tool, compression mold tool, or extruded mold tool that is utilized to create the lens and/or the texture on the lens by forming a texture on the surface of the tool. The texture may be created utilizing, for example, an acid-etch and/or bead blast on the tool surface. The amount of time sections of the tool surface are exposed to the acid etching and/or bead blasting will determine the depth of the texture along such sections. Also, for example, in other embodiments prisms, bumps, pits, random roughening, and/or truncated pyramids may be applied to and/or integrated within the surface of the lens 30. Also, for example, in some embodiments all or portions of the texturing may substantially conform to one or more texturing standards such as, for example, Mold-Tech, Yick Sang, VDI, etc and/or may optionally be created utilizing processes corresponding therewith. Also, for example, in some embodiments a holographic diffuser, microstructure diffuser, and/or other type of diffuser plate may be utilized to create the texture. For example, a holographic diffuser film could be placed inside the lens 30 and/or laminated to the lens 30.

Figure 3:
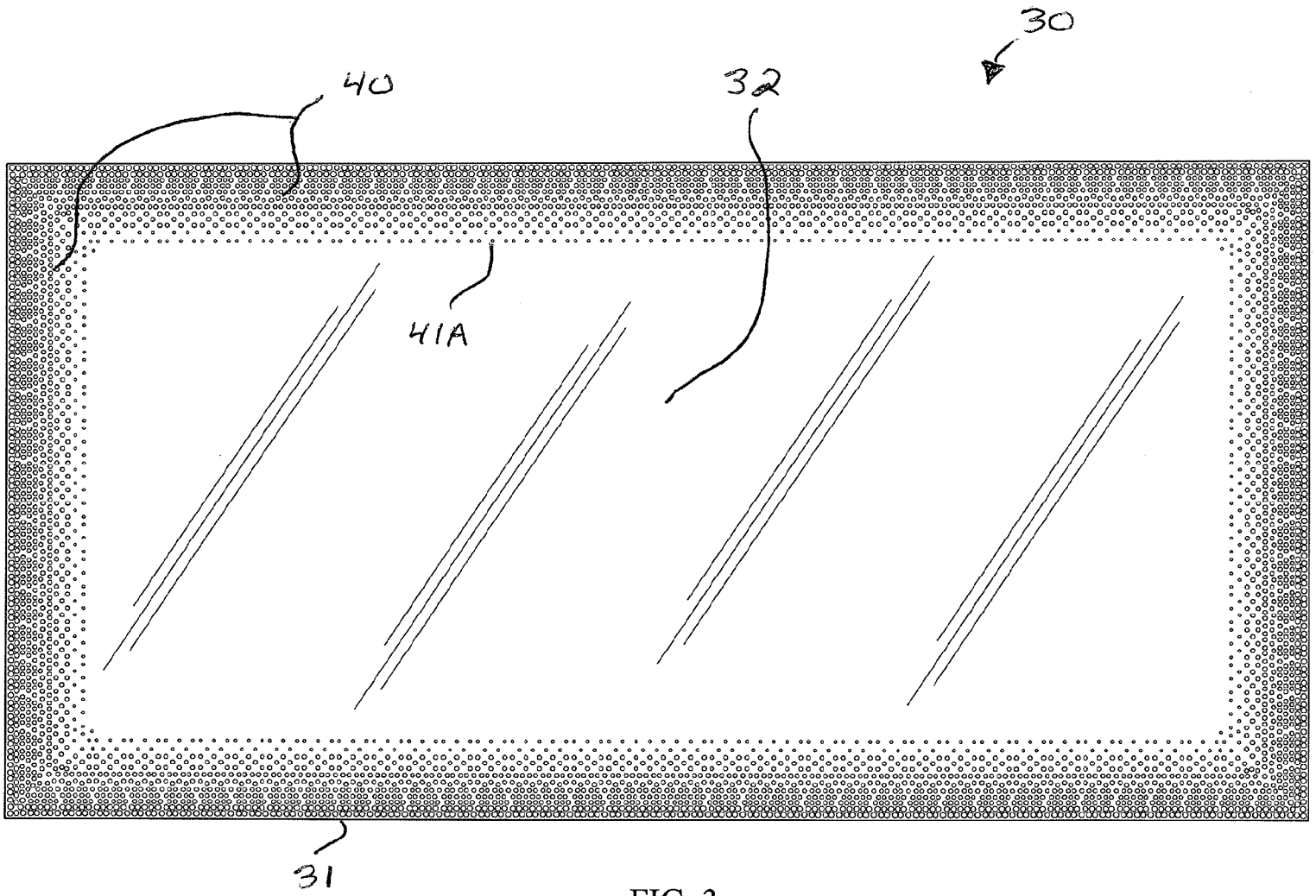
FIG. 3 illustrates a top view of the textured lens of FIG. 1.

Referring to FIG. 3, a top view of the textured lens 30 of FIG. 1 is illustrated. The lens 30 is planar, is generally rectangular, and is configured to cover a generally rectangular light exit opening 14 of the lighting fixture 10. In other embodiments the lens may be geometric shapes other than rectangular and/or may be non-planar. The textured section 40 in FIG. 3 is generally indicated by circles, the size and density of which generally correspond to the degree of texturing. The textured section 40 extends completely around the substantially texture-free section 32 and extends to the edge 31 of the lens 30. In alternative embodiments the textured section 40 may not extend completely around the substantially texture-free section 32 and/or may not extend to the edge 31. For example, in some embodiments the textured portion 40 may only extend along one side of the substantially texture-free section 32 and may stop short of the edge 31. Also, for example, in some embodiments the textured portion 40 may be configured to substantially correspond to a light output distribution emitted by a particular lighting fixture. For example, if a light output distribution is weighted to one side, the textured portion along all or some of that side may be wider, thinner, and/or non-existent. Also, for example, if a light output distribution has two distinct main beams, two separate substantially texture-free portions may be provided, each optionally surrounded by texturing. Also, for example, in some embodiments a texture-free portion may be provided in between the textured portion 40 and the edge 31. Optionally, such a texture-free portion may transmit minimal light therethrough when utilized in a lighting fixture and/or may be covered by a lip or other structure utilized to retain the lens within a lighting fixture.

The depicted substantially texture-free section 32 comprises a substantial majority of the surface area of the lens 30. In some embodiments the substantially texture-free section 32 may comprise more than ninety percent of the surface area of the lens 30. The depicted substantially texture-free section 32 also intersects a substantial majority of the light output intensity of the light output emitted by the LEDs 20R, 20G, 20B of lighting fixture 10. In some embodiments the substantially texture-free section 32 may intersect more than ninety percent of light output intensity of the light output emitted by the LEDs. For example, in some of those embodiments the lighting fixture 10 may emit light having a light output intensity with a substantially normal light output intensity distribution and the substantially texture-free section 32 may intersect the peak of the light output intensity and approximately forty-five percent of the light output intensity on either side of the peak.

Figure 4:
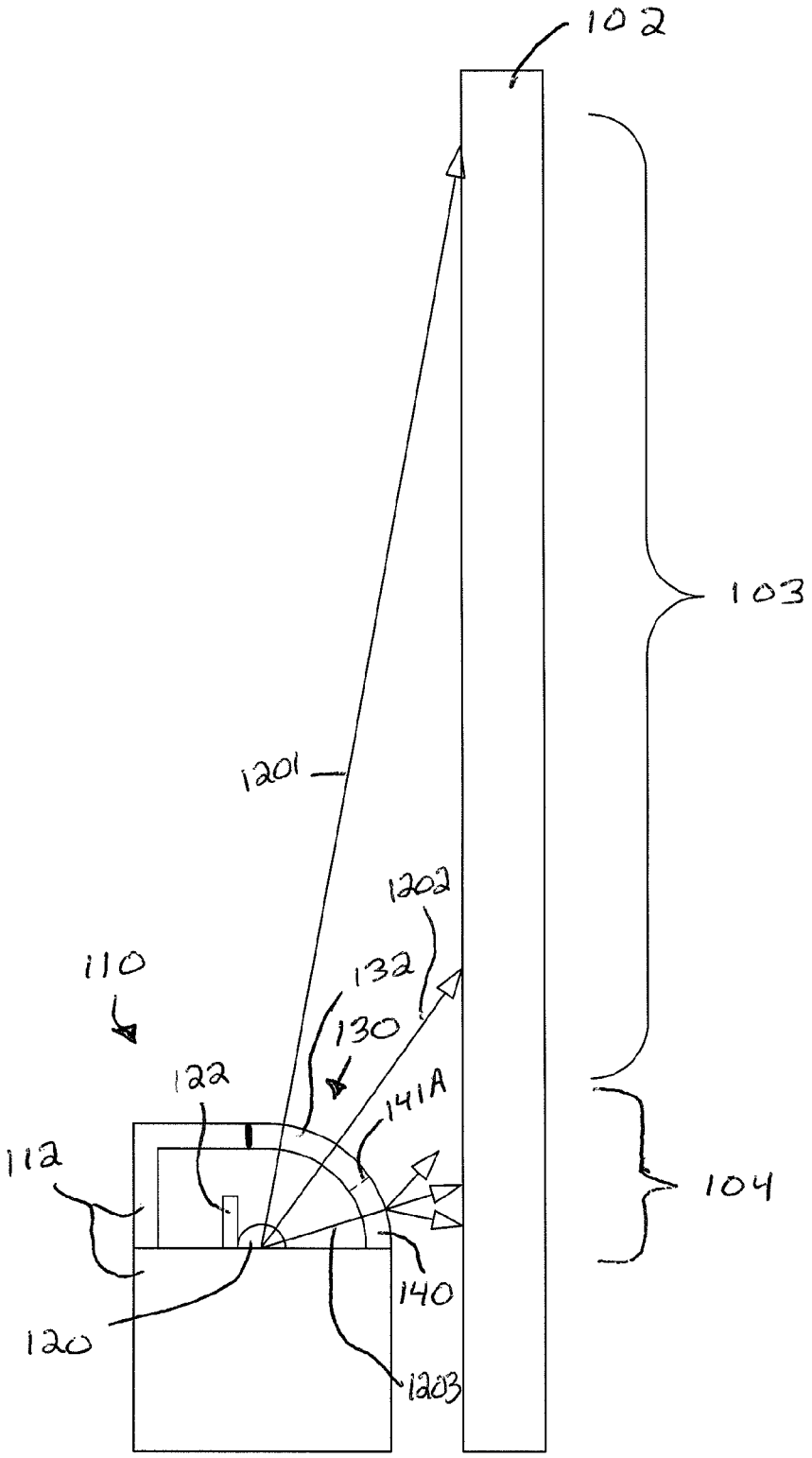
FIG. 4 illustrates a second embodiment of a lighting fixture having a textured lens across a light output opening thereof; the lighting fixture is shown adjacent an illumination surface.

Referring now to FIG. 4, a second embodiment of a lighting fixture 110 is provided with an arcuate textured lens 130. The lighting fixture 110 is illustrated schematically in FIG. 4 and includes a housing 112. The housing 112 retains the lens 130 across a light exit opening 114 of the lighting fixture 110. The housing 112 also retains a LED-based light source having a multi-die LED 120. The LED 120 may contain multiple dies emitting unique spectrums of light. Provided on one side of the LED 120 is a reflector 120 that is configured to generally direct light output from the LED 120 that is incident thereon toward the textured lens 130.

Three exemplary light rays 1201, 1202, and 1203 are depicted emanating from the LED 120. It is understood that the LED 120 will emit many other light rays than those depicted herein, some of which may contact and be redirected by the reflector 120. The light rays 1201-1203 may be emitted from a single die of the LED 120 or may be emitted from multiple dies thereof. Light rays 1201 and 1202 are each directed toward a substantially texture-free portion 132 of the lens 130 and are transmitted therethrough without being substantially scattered. Other light rays will likewise contact the substantially texture-free portion 132 of the lens 130 and be transmitted therethrough without being substantially scattered. The substantially texture-free portion 132 may optionally alter the path of light rays transmitted therethrough depending on one or more factors such as, for example, the index of refraction of the substantially texture-free portion 132, the incidence angle of the light ray(s), and/or the thickness of the substantially texture-free portion 132. The light transmitted through the substantially texture-free portion 132 is generally directed toward a main beam portion 103 of an illumination area 102. The substantially texture-free portion 132 may optionally have a light texturing applied thereto.

Light ray 1203 contacts a textured portion 140 of the lens 130 and is transmitted through, and scattered by, the textured portion 140. The beginning of the textured portion 140 of the lens 130 is generally indicated by imaginary dashed line 141A and it extends to the edge of the lens 130. The textured portion 140 is provided peripherally of the substantially texture-free portion 132, but is only provided along one side thereof toward a bottom edge of the lens 130. In alternative embodiments the textured portion 140 may additionally or alternatively be provided along the top edge of the lens 130 and/or one or more sides of the lens 130. Other light rays will contact the textured portion 140 (some after contacting reflector 122 one or more times) and will likewise be transmitted through and scattered by the textured portion 140. As described herein, the depth of the texturing of textured portion 140 may gradually increase as it moves from dashed line 141A to the edge of the lens 140. The textured portion 140 may optionally alter the path of light rays transmitted therethrough (in addition to altering of the path via scattering caused by the texturing) depending on one or more factors such as, for example, the index of refraction of the textured portion 140, the incidence angle of the light ray(s), and/or the thickness of the textured portion 140.

Figure 5:
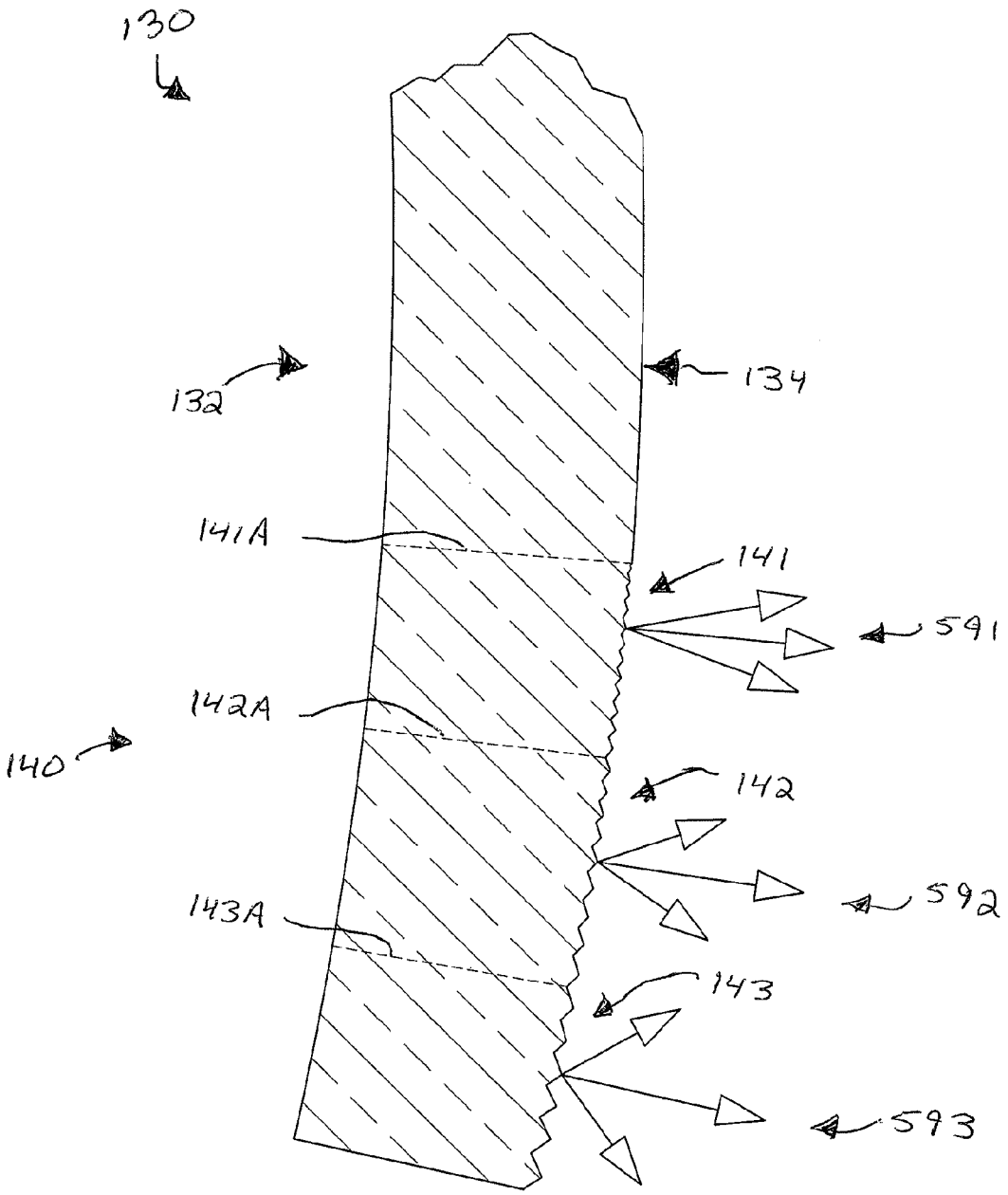
FIG. 5 illustrates a section view of a portion of the textured lens of FIG. 4.

FIG. 5 illustrates a section view of a portion of the textured lens of FIG. 4. The section includes a bottom edge 131 of the lens 130 and is taken along a portion of the textured portion 140 and a portion of the texture-free portion 132. It is illustrated that the texture-free portion 132 has a substantially smooth texture-free exterior face 134. The imaginary dashed line 141A generally represents the beginning of the textured portion 140 and the beginning of a lightly textured section 141 thereof. Dashed line 142A generally represents the beginning of a medium textured section 142 of the textured portion 140 and dashed line 143A generally represents the beginning of a heavy textured section 143 of the textured portion 140. It is illustrated that the degree of texturing increases gradually across each section 141, 142, 143 as you move outward from the substantially texture-free section 132. For example, the degree of texturing in lightly textured section 141 is greater close to dashed line 142A than it is close to dashed line 141A. Light rays 591, 592, 593, are illustrated transmitted through respective sections 141, 142, 143. It is illustrated that the degree of scattering of the light rays 591, 592, 593 increases as the degree of texturing increases.

In some embodiments, the degree of texturing may increase linearly across all or portions of textured portion 140. In other embodiments the degree of texturing may additionally or alternatively increase exponentially and/or vary according to some other function across all or portions of textured portion 140. In versions of those embodiments the depth may be substantially consistent across the width of each of the zones 141-143. In other versions the depth may vary across the width of one or more of the zones 141-143. The surface of the textured section 140 can be textured in many ways for light scattering or redirecting the light and all or portions of the texturing may conform to one or more texturing standards.

In some embodiments, texturing may be applied to only approximately one to two percent of a lens. In some versions of those embodiments the texturing may be applied along the periphery of the lens. In some embodiments texturing may be applied to up to half of the lens. In some versions of those embodiments the texturing may be applied along the periphery of the lens inward. In some embodiments the textured portion of the lens may intersect anywhere from one to fifty percent of a total light output intensity that is incident on a lens. One of ordinary skill in the art, having had the benefit of the present disclosure, will recognize and appreciate that other applications of texturing to a lens may also be implemented utilizing teachings hereof.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Further, any reference numerals appearing in parentheses in the claims are merely for convenience and should be interpreted as limiting in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

What is claimed is:

1. A lighting fixture, comprising:

a LED light source, said LED light source emitting a light output;

a lens provided in front of said LED light source, said lens having a substantially texture-free portion and a textured portion;

wherein said substantially texture-free portion intersects at least half of a light output intensity of said light output; and wherein as said textured portion extends farther from said texture-free portion and closer to said a periphery of said lens, texturing thereof transitions from a first texturing having a first depth, to a second texturing having a second depth greater than said first depth, to a third texturing having a third depth greater than said second depth.

2. The lighting fixture of claim 1, wherein said textured portion is provided around a substantial portion of said periphery of said lens.

3. The lighting fixture of claim 2, wherein said textured portion is provided around the entirety of said periphery of said lens.

4. The lighting fixture of claim 1, wherein said texture-free portion constitutes a substantial portion of said lens.

5. The lighting fixture of claim 4, wherein said texture-free portion constitutes at least eighty percent of said lens.

6. The lighting fixture of claim 2, wherein said lens is an outermost lens of said lighting fixture.

7. A lighting fixture, comprising:

a housing;

a LED light source retained within said housing, said LED light source emitting a light output having a light output intensity and a plurality of different spectrums;

a lens coupled to said housing and intersecting at least some of said light output, said lens having a substantially texture-free portion and a textured portion;

wherein said texture-free portion intersects a continuous at least half of said light output intensity including a median value of said light output intensity; and wherein said textured portion gradually transitions from a first texturing having a first depth to a second texturing having a second depth at least four times greater than said first depth, wherein said first texturing is more proximal to said texture-free portion than said second texturing is to said texture-free portion.

8. The lighting fixture of claim 7, wherein said texture-free portion intersects at least seventy percent of said light output intensity.

9. The lighting fixture of claim 7, wherein said texture-free portion intersects at least ninety percent of said light output intensity.

10. The lighting fixture of claim 7, wherein said textured area is provided around at least a majority of a periphery of said lens.

11. The lighting fixture of claim 7, wherein said lens is substantially planar.

12. The lighting fixture of claim 11, wherein said lens is rectangular.

13. The lighting fixture of claim 7, wherein said texture-free portion is completely texture-free.

14. A lighting fixture, comprising:

a LED light source emitting a light output having a light output intensity;

a lens including a texture-free portion and textured portion across at least a portion of said lens;

wherein said lens intersects at least some of said light output; and wherein said texture-free portion constitutes a substantial portion of said lens;

wherein said textured portion includes a first texture zone distal from an edge of said lens having a first average depth and a second texture zone more proximal to said edge than said first texture zone, said second texture zone having a second average depth at least twice said first average depth.

15. The lighting fixture of claim 14, wherein said textured portion is integrally formed in an exterior facing surface of said lens.

16. The lighting fixture of claim 14, wherein said lens includes a texture-free portion interior of said textured portion.

17. The lighting fixture of claim 16, wherein said texture-free portion intersects at least fifty percent of said light output intensity of said intersected light.

18. The lighting fixture of claim 1, wherein said fixture further comprises a housing defining at least one light output opening, wherein said LED light source includes a plurality of LED dies and is retained within said housing, wherein at least some of said light output travels through said at least one light output opening, wherein said lens is provided across said at least one light output opening, and wherein said textured portion is provided along at least a portion of the periphery of said lens.

19. The lighting fixture of claim 14, wherein said fixture further comprises a housing, wherein said LED light source is a multi-spectrum LED light source retained within said housing, wherein said lens is coupled to said housing, and wherein said textured portion extends substantially to the edge of said lens and wherein the first average depth is less than 0.002 inches.

20. A lighting fixture, comprising:

a LED light source, said LED light source emitting a light output;

a lens receiving at least a portion of said light output, said lens having a substantially texture-free portion and a textured portion; and a reflector disposed in front of said substantially texture-free portion and blocking at least another portion of said light output directed toward said lens, wherein said textured portion extends passed an outer edge of said reflector, and wherein as said textured portion extends farther from said texture-free portion and closer to a periphery of said lens, texturing thereof transitions from a first texturing having a first depth, to a second texturing having a second depth greater than said first depth, to a third texturing having a third depth greater than said second depth.

* * * * *